US011204227B2

(12) United States Patent
Sansour

(10) Patent No.: US 11,204,227 B2
(45) Date of Patent: Dec. 21, 2021

(54) BREACHING DEVICE WITH TAMPING GEL

(71) Applicant: Esoteric, LLC, High Point, NC (US)

(72) Inventor: Yousef Sansour, High Point, NC (US)

(73) Assignee: Esoteric, LLC, High Point, NC (US)

( * ) Notice: Subject to any disclaimer, the term of this patent is extended or adjusted under 35 U.S.C. 154(b) by 0 days.

(21) Appl. No.: 17/050,094

(22) PCT Filed: Apr. 29, 2019

(86) PCT No.: PCT/US2019/029634
§ 371 (c)(1),
(2) Date: Oct. 23, 2020

(87) PCT Pub. No.: WO2019/210299
PCT Pub. Date: Oct. 31, 2019

(65) Prior Publication Data

US 2021/0116225 A1 Apr. 22, 2021

Related U.S. Application Data

(60) Provisional application No. 62/662,506, filed on Apr. 25, 2018.

(51) Int. Cl.
*F42D 3/00* (2006.01)
*F42D 1/20* (2006.01)
(Continued)

(52) U.S. Cl.
CPC ..... *F42D 1/28* (2013.01); *F42B 3/00* (2013.01); *F42B 3/02* (2013.01); *F42B 3/22* (2013.01);
(Continued)

(58) Field of Classification Search
CPC ..... F42D 1/00; F42D 1/02; F42D 1/20; F42D 1/22; F42D 1/24; F42D 1/28; F42D 3/00;
(Continued)

(56) References Cited

U.S. PATENT DOCUMENTS 4,628,819 A * 12/1986 Backofen, Jr. ..... F42B 3/28 102/303
4,836,079 A * 6/1989 Barrett ..... B22C 3/00 86/50
(Continued)

FOREIGN PATENT DOCUMENTS

CA 2314808 A1 * 5/2001 ..... F42B 1/02
EP 0142717 A1 * 5/1985 ..... F42D 3/00
(Continued)

OTHER PUBLICATIONS

English language machine translation of EP 0 940 647 A2, Deutsch-Hans-Henning (Year: 1999).*
(Continued)

*Primary Examiner* — James S Bergin
(74) *Attorney, Agent, or Firm* — Womble Bond Dickinson (US) LLP

(57) ABSTRACT

A breaching device includes a body having a tamping material. The body has a target surface that is configured to face a target to be breached and a backing surface that is opposite the target surface. The tamping material is formed of gel and is configured to reflect an explosive force directed way from the target surface towards the target surface.

21 Claims, 9 Drawing Sheets

(51) Int. Cl.

| | |
|---|---|
| ***F42D 1/28*** | (2006.01) |
| ***F42D 1/00*** | (2006.01) |
| ***F42D 1/24*** | (2006.01) |
| ***F42D 5/045*** | (2006.01) |
| ***F42B 3/02*** | (2006.01) |
| ***F42B 3/00*** | (2006.01) |
| ***F42B 3/22*** | (2006.01) |

(52) U.S. Cl.
CPC ..... *F42D 1/00* (2013.01); *F42D 1/20* (2013.01); *F42D 1/24* (2013.01); *F42D 3/00* (2013.01); *F42D 5/045* (2013.01)

(58) Field of Classification Search
CPC ... F42D 3/02; F42D 5/00; F42D 5/045; F42D 5/05; F42D 3/04; F42B 3/00; F42B 3/02; F42B 3/08; F42B 3/087; F42B 3/093; F42B 3/22
USPC ..... 102/301, 303, 333; 86/50
See application file for complete search history.

(56) References Cited

U.S. PATENT DOCUMENTS

| | | | | |
|---|---|---|---|---|
| 4,905,601 | A | 3/1990 | Gabriel et al. | |
| 5,415,101 | A | 5/1995 | Brinkmann | |
| 6,269,725 | B1 * | 8/2001 | Cherry | F42B 1/02 102/306 |
| 7,337,703 | B2 * | 3/2008 | Sansolo | F42D 3/00 102/307 |
| 7,406,909 | B2 * | 8/2008 | Shah | F41H 5/04 228/2.5 |
| 7,536,956 | B2 | 5/2009 | Sammons et al. | |
| 7,819,063 | B1 | 10/2010 | Lehman | |
| 8,146,503 | B2 | 4/2012 | Murray et al. | |
| 10,048,053 | B2 * | 8/2018 | Klein | F42D 1/20 |
| 2007/0089595 | A1 | 4/2007 | Shah et al. | |
| 2017/0122715 | A1 | 5/2017 | Klein | |
| 2019/0154413 | A1 * | 5/2019 | Graham | F42B 3/28 |
| 2021/0231416 | A1 * | 7/2021 | Green | F42B 1/028 |

FOREIGN PATENT DOCUMENTS

| | | | | |
|---|---|---|---|---|
| EP | 0940647 | A2 * | 9/1999 | F42B 3/08 |
| GB | 2583548 | A * | 11/2020 | F42D 1/24 |
| WO | WO-2007099359 | A1 * | 9/2007 | F42D 1/20 |

OTHER PUBLICATIONS

International Search Report and Written Opinion for PCT/US19/29634, dated Jul. 12, 2019, 11 pgs.

* cited by examiner

BREACHING DEVICE WITH TAMPING GEL

CROSS-REFERENCE TO RELATED APPLICATIONS

This application is a National Stage Filing of PCT/US/029634, filed Apr. 29, 2019, which claims the benefit of, and priority to, U.S. Provisional Patent Application Ser. No. 62/662,506, filed Apr. 25, 2019, the entire contents of which are hereby incorporated by reference.

BACKGROUND OF THE INVENTION

Tactical teams, including law enforcement special weapons and tactics (SWAT) teams and Hostage Rescue Teams (HRT), military, paramilitary, special operations forces, and similar teams from other government agencies are often faced with making forcible entry in to a structure. Gaining entry or reducing obstacles is generally referred to as Breaching. Breaching may be accomplished by mechanical means (Mechanical Breaching) or by explosive means (Explosive Breaching). As used herein, the term "Explosive Breaching" is defined as the use of explosive charges or assemblies to gain entry or to reduce obstacles.

Explosive Breaching is used in high-risk circumstances when speed, likelihood of success, and maintaining the element of surprise to create an entry point into a structure or to bypass a barricade is desired. Explosive Breaching can be used to create an entry point in a fixed structure at a door or through windows, gates, walls, or roofs. In addition, Explosive Breaching can be used to create an entry point in vehicles such as a bus, train, airplane, or ship. Explosive Breaching can also be used to create an entry point by defeating or "blowing" a single lock on a door, open a vehicle trunk, or reduce another form of obstruction.

Tamping can be used in Explosive Breaching to direct and enhance the force of an explosive charge and/or increase the effectiveness of the charge with respect to a given target. Tamping involves the use of tamping materials around and explosive charge. Tamping materials reflect the force of an explosive charge towards a target. For example, when a limpet mine is attached to the hull of a ship beneath the waterline, the surrounding water acts as a low-compression tamping material to reflect the explosive force of the limpet mine against the steel hull of the ship making the limpet mine more effective than if the limpet mine was used above the waterline, i.e., not surrounded by water. When used in Explosive Breaching, tamping materials can increase the effectiveness of a given charge and/or permit the use of a smaller charge size for a given mission, objective, or target type. Tamping materials are used to contain and distribute explosive energy towards a target. In contrast, when tamping materials are not used, a great deal of explosive energy can be lost in directions away from the target resulting in a failed breach, a poor blast, or in a larger amount of explosive being required to ensure a successful breach.

Tamping can reduce the amount of explosives required which may reduce standoff requirements (the distance the tactical team must be away from the entry point that is the subject of the explosive breaching charge), may decrease a risk of collateral damage, may reduce overpressure effects, and may reduce dangerous fragmentation effects from the explosion.

Tamping and Explosive Breaching devices can suffer from several drawbacks. For instance, the explosive force may cause the tamping material to fracture and produce dangerous fragments that may harm the user. In some devices, water is used as a tamping material to eliminate the hazards associated with flying fragments. Water is heavy and when used as a tamping agent, the charge becomes heavy, difficult to handle and transport. For example, 1000 ml bags of intravenous solution are readily available and oftentimes used to tamp charges. For a residential door, 3 or even 6 bags may be used, adding 7 to 14 pounds of weight to the charge assembly. Once a water-tamped charge is built for a specific target objective, it is not easily altered or adapted if the situation on the objective changes or requires a different configuration than anticipated. Furthermore, the added weight and size of water-tamped charges make the charge more difficult to place and in many occasions requiring special adhesives and or a prop stick to hold the charge in place. The increased amount of construction material that must be used in connection with current tamping agents, such as water, increases the amount of shrapnel or fragmentation cast off by the explosion, endangering the tactical team as well as any hostages or others in the vicinity, and increases the possibility of injury and property damage. In addition, use of tamping agents such as water creates a wet and slippery post-blast environment, at a time when the tactical team may be trying to make a coordinated entry into a structure. In extreme environments, there is also the risk of the water freezing, or of the water base being punctured. Aqueous gels, freezer packs or cryo-packs, and other non-water substances have been tried as alternatives to water, with varying success. Many of these alternatives are similarly heavy, difficult to configure, or are expensive. Accordingly, there remains a need for a more efficient tamping and breaching device without the drawbacks noted above.

SUMMARY OF THE INVENTION

The present invention fulfills one or more of these needs in the art by providing a tamping device for explosive breaching that minimizes hazards associated with detonating an explosive and which performs better and with fewer drawbacks than water tamping.

In an embodiment of the present disclosure, a breaching device includes a body having a tamping material. The body has a target surface that is configured to face a target to be breached and a backing surface that is opposite the target surface. The tamping material is formed of gel and is configured to reflect an explosive force directed away from the target surface towards the target surface.

In embodiments, the tamping material is a silicone gel. The tamping material may have a Shore hardness in a range between about 020 and about 040 and may be about 035.

In some embodiments, the target surface of the body may have an elongate rectangular shape. The body may have a width in a range between about 0.5 inches and about 1.5 inches and a height measured between the target surface and the backing surface in a range between about 0.5 inches and about 2 inches. The body may have a length in a range between about 6 inches and about 80 inches. Alternatively, the target surface of the body may have a circular shape. The target surface may have a diameter in a range of about 4 inches to about 16 inches. The target surface of the body may be planar.

In particular embodiments, the tamping material forms the backing surface of the body. The backing surface may be planar. The tamping material may define a groove in a surface configured to face the target. The groove may be configured to receive an explosive material. The entire body may be formed of non-metallic materials.

In certain embodiments, the body includes a pushing medium that forms the target surface of the body. The pushing medium is configured to press into a target in response to and distribute the explosive force at a portion of the target. The body may be separable along a boundary between the tamping material and the pushing medium. The target surface may include an adhesive configured to attach the body to the target. The breaching device may be convertible from a pushing charge to a blasting charge.

In embodiments, the breaching device includes a housing having two sidewalls interconnected by a backing wall. Each sidewall is formed along a side surface of the body and the backing wall is formed along the backing surface of the body. The side surfaces of the body interconnect the target surface and the backing surface. Each sidewall of the housing may include a perforation line that is aligned with the boundary between the tamping material and the pushing medium and is configured to provide visual indicia of the position of the boundary. The housing may include a perforation line that extends around an outer surface of the housing in each of the sidewalls and the backing wall. The perforation line may be configured to provide visual indicia of a predetermined length from an end of the body. The housing may be formed of cardboard. The body may include a protruding portion that extends beyond a first end of the housing and a second end of the housing may extend beyond the body to form a void between the second end of the housing and the body. The void may be configured to receive a protruding portion of another breaching device.

In another embodiment of the present disclosure, a breaching kit includes a first breaching device and a second breaching device. Each of the first and second breaching devices may be any of the breaching devices detailed herein.

In embodiments, the first breaching device may be configured to interlock with the second breaching device to form a single breaching device.

The housing may be used to form and contain the tamping gel during the manufacturing process, and may also provide a substrate that assists in completing the final assembly using tape or other methods. The casing may include cardboard or other lightweight material that is less harmful or less likely to produce injury-inducing shrapnel as a result of the detonation of the explosive material. For example, the housing may include plastic material.

The protruding portion may be located at one end of the device and the cavity may be located at an opposing end of the device. The protruding portion may be inserted into a cavity of a second tamping and breaching device to form an interlocking pair of tamping and breaching devices. The interlocking nature of embodiments provides a breaching device that is easily transported and may be assembled on-scene into the desired length. In embodiments, the breaching device includes of three interlocking lengths, with each length being about 26.5 inches, and with the completed assembly of the three interlocking lengths having an overall length of about 79.5 inches. This embodiment has an unassembled length of 26.5 inches, which may be easily transported on the person of a member of a tactical team. When this embodiment is assembled with the explosive material, it may be used to explosively breach a typical-size residential door found in the United States.

In some embodiments, more than one section of the elongate form can be configured in a polygon having multiple sides. For example, four sections of the elongate form of the tamping assembly complete with the explosive material could be arranged in a square in order to explosively breach an opening in a wall, the roof of a structure, or the upper floor of a multi-level structure, permitting entry through a point other than a door or window.

Certain embodiments of the present disclosure may include some, all, or none of the above advantages. One or more other technical advantages may be readily apparent to those skilled in the art for the figures, descriptions, and claims included herein. Moreover, while specific advantages have been enumerated above, various embodiments may include all, some, or none of the enumerated advantages.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION OF EXAMPLES OF THE INVENTION

Figure 1:
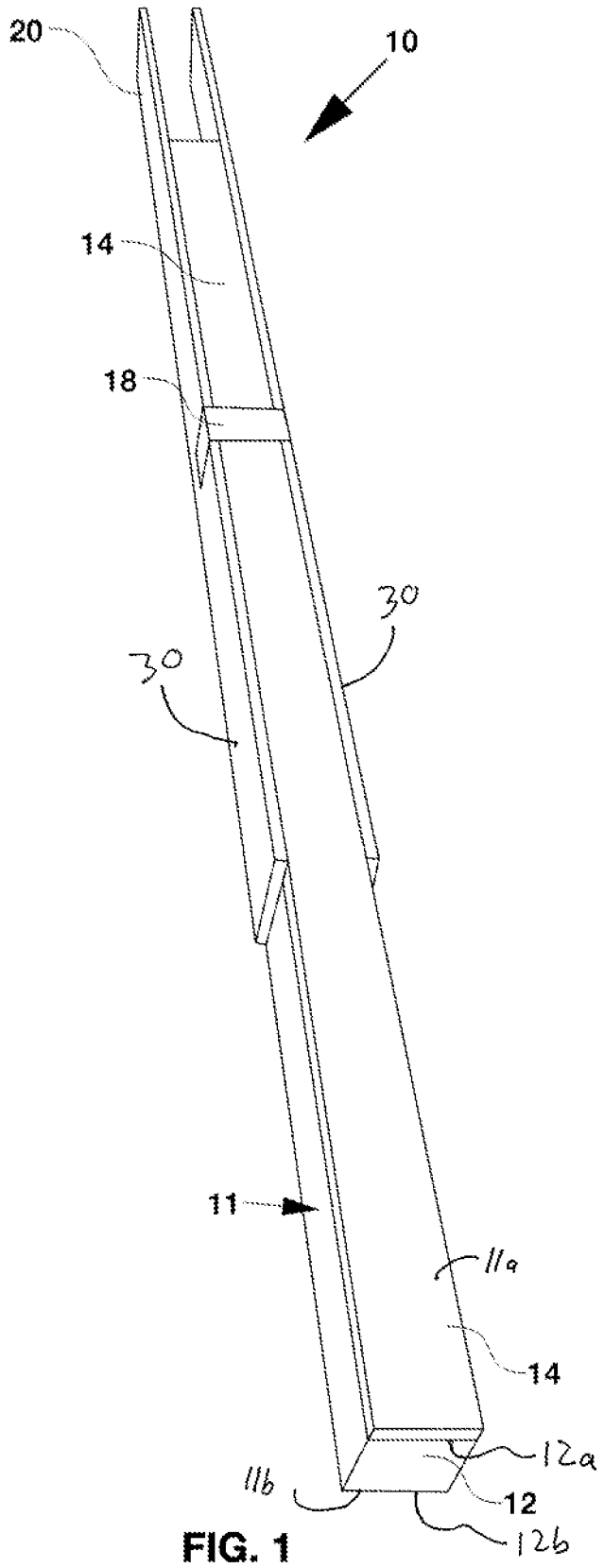
FIG. 1 is a top perspective view of an exemplary breaching device provided in accordance with the present disclosure.
Figure 2:
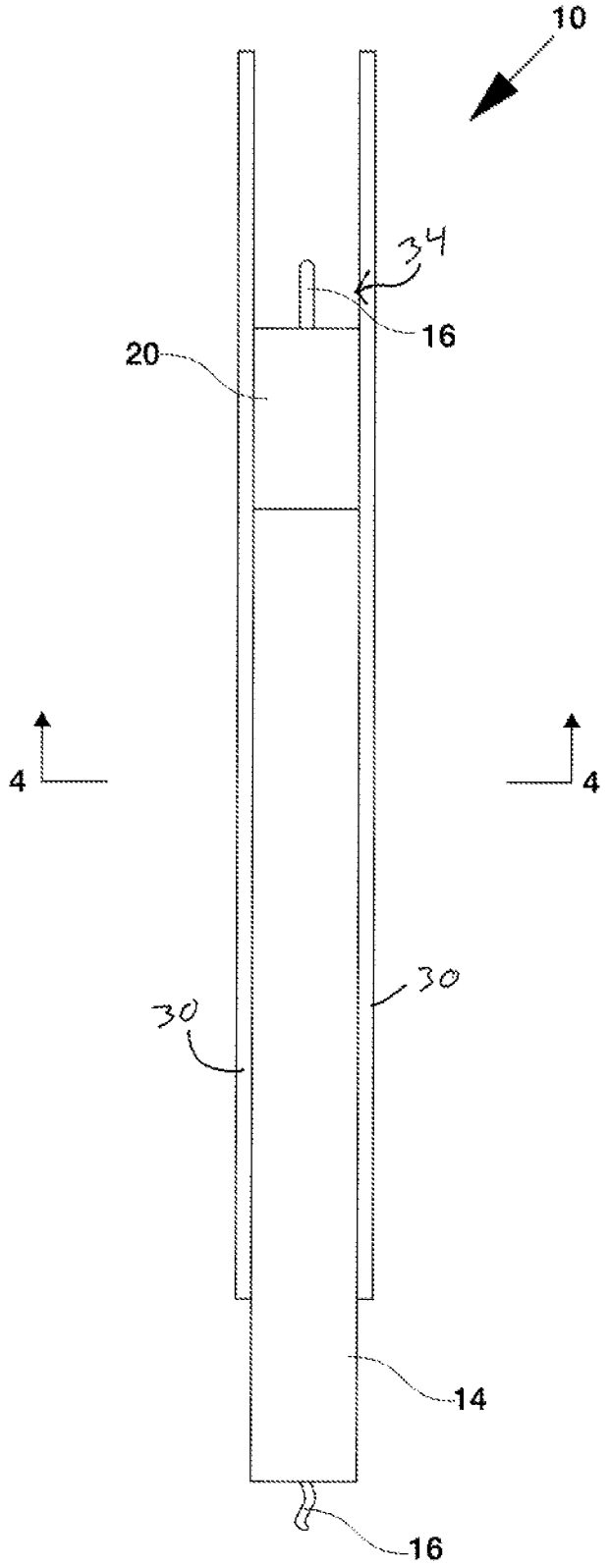
FIG. 2 is a top plan view the breaching device of FIG. 1 including explosive material disposed therein.

Referring to FIGS. 1-4, an exemplary tamping and breaching device is provided in accordance with the present disclosure and is generally identified as breaching device 10. The breaching device 10 includes a body 11 having a tamping material 12. As shown, the tamping material 12 has a rectangular cross-section with a substantially linear target surface 12*a* configured to face a target and a back surface 12*b* configured to face an environment opposite the target. In some embodiments, the tamping material 12 has a semi-circular, a semi-elliptical, or a semi-ovular cross-section with the target surface 12*a* being substantially linear and the back surface 12*b* being arcuate. In some embodiments, the tamping material 12 has a triangular or semi-polygonal cross-section with the target surface 12*a* being substantially linear and the back surface 12*b* including one or more substantially linear faces or surfaces.

The tamping material 12 is configured to direct or reflect an explosive force towards a target. By reflecting an explosive force towards the target, an amount of explosive material and/or explosive energy directed away from the target may be reduced. By reducing the explosive material and/or explosive energy directed away from the target, the efficiency of a given explosive force may be increased, a reduction in debris directed away from the target may be obtained, and a risk of harm to the personnel using the breaching device 10 may be reduced. In addition, the safe standoff distance for a given weight of explosive material may be reduced.

The tamping material 12 may be a soft yet strong gel. The tamping material 12 may be a non-aqueous gel. For example, the tamping material 12 may be a gel with a Shore hardness tested under American Society for Testing and Materials International Standards (ASTM) D2240 in a range of about 020 to about 040. In embodiments, the tamping material may be a silicone gel having a Shore hardness of about 35 (ASTM D2240). The softness of the tamping material 12 may reduce hazards of debris created if the tamping material 12 fractures during an Explosive Breaching operation. The tamping material 12 may be useable in a temperature range of about −40° F. to about 450° F. may have other physical properties such as:

Tensile Strength of about 12 psi
ASTM D412
Ultimate Elongate of about 60%
ASTM D412
Density of 0.967 g/cm$^3$
ASTM D297 with Die C dumbbells tested at 20 inches/minute
Tear Resistance of about 13 lbf/inch
ASTM D624 with Die C Specimens tested at 20 inches/minute
Compression Set of about 25.7%
ASTM D395—Method B—Specimens aged 22 hrs. @ 158° F., 25% deflection, ½ hr. recovery Some examples of suitable tamping materials 12 include, but are not limited to, Ecoflex™ Gel available from Smooth-On, Inc. of Macungie, Pa. Such a tamping material 12 may be non-toxic, may not melt, and/or may not create a slip hazard after a breaching operation.

Continuing to refer to FIGS. 1-4, the body 11 may also include a pushing medium 14. When used, the pushing medium 14 is disposed along the target surface 12*a* of the tamping material 12 such that the target surface 12*a* of the tamping material 12 forms a boundary with the pushing medium 14. The pushing medium 14 is configured to press onto and/or into the target as a result of an explosive force and distribute the explosive force at a portion of the target. The pushing medium 14 may be separable from the tamping material 12 to allow for installation of an explosive material 16 (FIG. 2) as described in detail below. In some embodiments, the pushing medium 14 is integrally formed with the tamping material 12. When used without a pushing medium 14, the breaching device 10 functions as a blasting charge as explained in greater detail below.

The pushing medium 14 may include polyethylene strips or rubber belting. The pushing medium 14 may be a rubber that is capable of stretching to many times its original size without tearing while being resilient to rebound to its original form without distortion. For example, the pushing medium 14 may be a rubber belt formed of Styrene Butadiene Rubber ("SBR"). The rubber belt may be about 0.30 inches to about 0.70 inches thick, e.g., about 0.47 inches thick, may have a working tension of about 330 lbs./inch of width, and may be capable of withstanding temperatures in a range of about −25° F. to about 225° F. When the pushing medium 14 includes polyethylene strips, the polyethylene strips may have similar properties to the rubber belt detailed above. Alternatively, other materials may be used as a pushing medium 14.

The pushing medium 14 may include a reinforcing material 13 configured to maintain a shape of the pushing medium 14 and/or to secure the pushing medium 14 within the housing 20. The reinforcing material 14 may be a fabric or other non-metal fiber reinforcement that is secured to or integrally formed with the pushing medium 14.

With continued reference to FIGS. 1-4, the breaching device 10 may include a housing 20 that defines a cavity 34 configured to receive the body 11 therein. The housing 20 may be constructed of a pliable yet rigid material. In embodiments, the housing 20 is constructed of a cardboard. The housing 20 may enhance the stiffness of the body 11, prevent damage to the device 10 before use, or may function as a liner along the sides of the body 11. The housing 20 includes two sidewalls 30 that are substantially parallel to one another and extend along a length of the body 11. Alternatively, the housing 20 may have a curvilinear or arcuate profile to compliment a shape of the tamping material 12. For example, when the backing surface 12*b* of the tamping material 12 has an arcuate profile, the sidewalls 30 and/or the backing wall 32 of the housing 20 may have a complimentary arcuate profile to the tamping material 12. The sidewalls 30 may be secured to one another by a fastening element 18 such as a piece of tape. The fastening element 18 may also prevent the body 10 from sliding within the cavity 34 of the housing 20. The sidewalls 30 may be substantially rigid and have a thickness of about 0.1 inches. In some embodiments, the housing 20 includes waterproof or water-resistant cardboard. The housing 20 may be formed of a chipboard having a thickness of about 0.1 inches. In some embodiments, the housing 20 may include a backing wall 32 (FIGS. 3 and 5) that interconnects the sidewalls 30 and may contact a portion of the back surface 12*b* of the tamping material 12.

Figure 5:
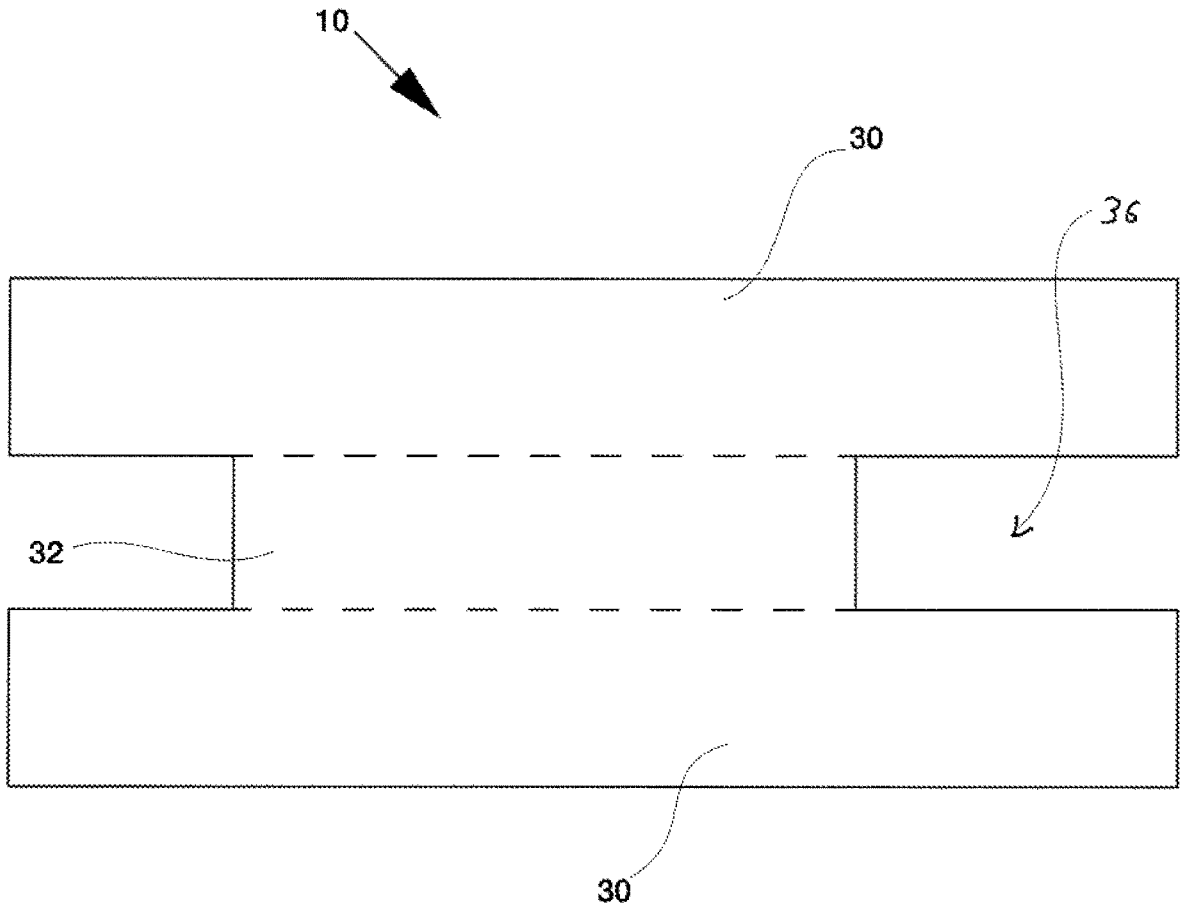
FIG. 5 is a top plan view of an unfolded housing of the breaching device of FIG. 1.

With additional reference to FIG. 5, an embodiment of the housing 20 is shown in an unformed or unfolded state. In this particular configuration, the backing wall 32 has a length shorter than a length of the sidewalls 30. When the housing 20 is assembled by folding around the body 11, the sidewalls 30 form and border the cavity 34 into which the body 11 is received or nested within. The housing 20 may also act as a form or mold for the tamping material 12 during formation of the tamping material 12. For example, the tamping material 12 may be poured into the housing 20 and cure within the housing 20. With the tamping material 12 cured within the housing 20, the pushing medium 14 and/or reinforcement material 14 may be disposed within the housing 20 to form the body 11. In embodiments, the backing wall 32 has a length equal to a length of the sidewalls 30 such that ends of the backing wall 32 are adjacent ends of each of the sidewalls 30. In particular embodiments, the backing wall 32 has a length equal to a length of the sidewalls 30 and is longitudinally offset from each of the sidewalls 30 such that ends of the backing wall 32 are offset from ends of the sidewalls 30.

Figure 3:
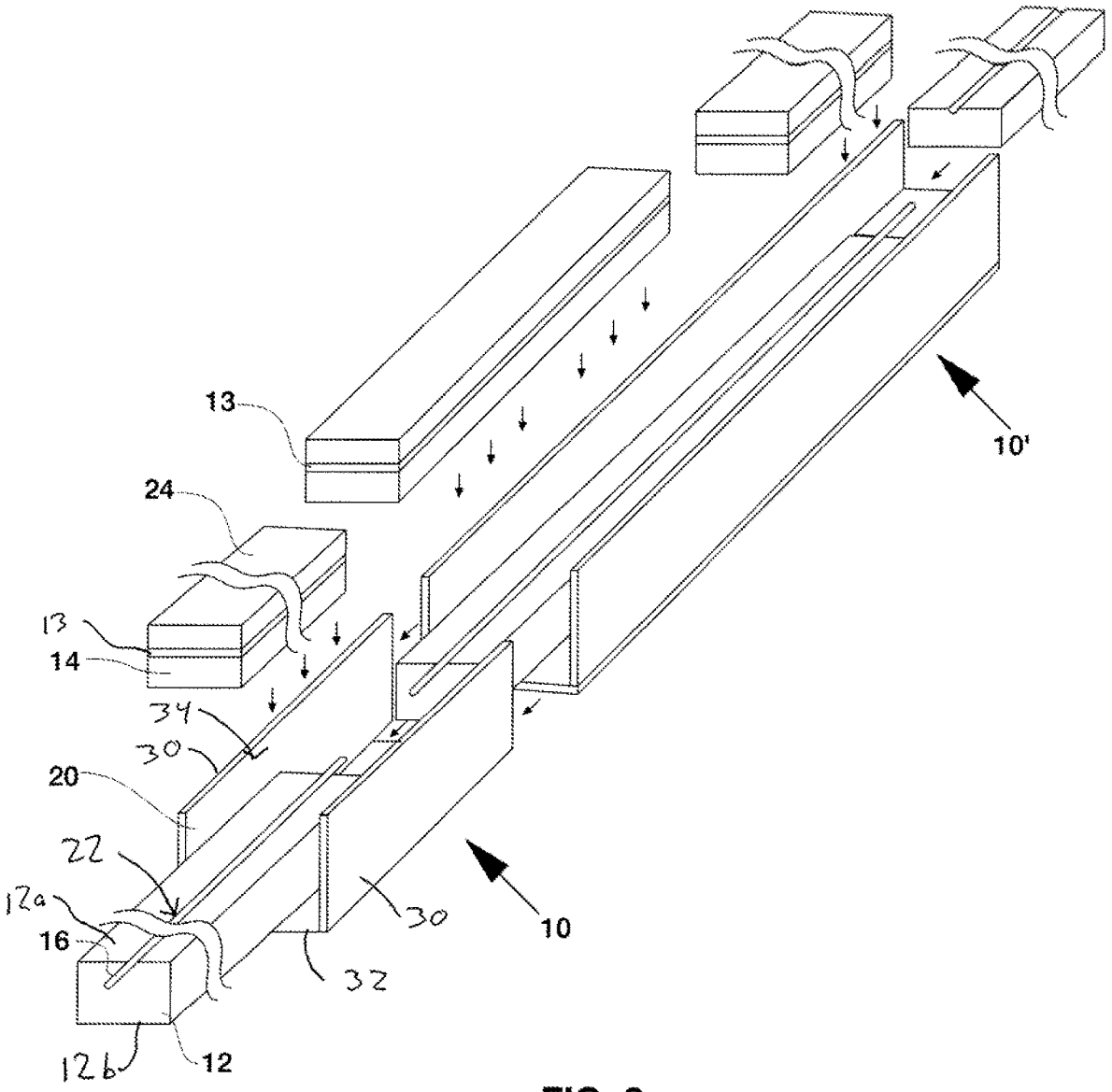
FIG. 3 is an overhead perspective view of a kit including multiple breaching devices of FIG. 1 partially disassembled and including explosive material.
Figure 4:
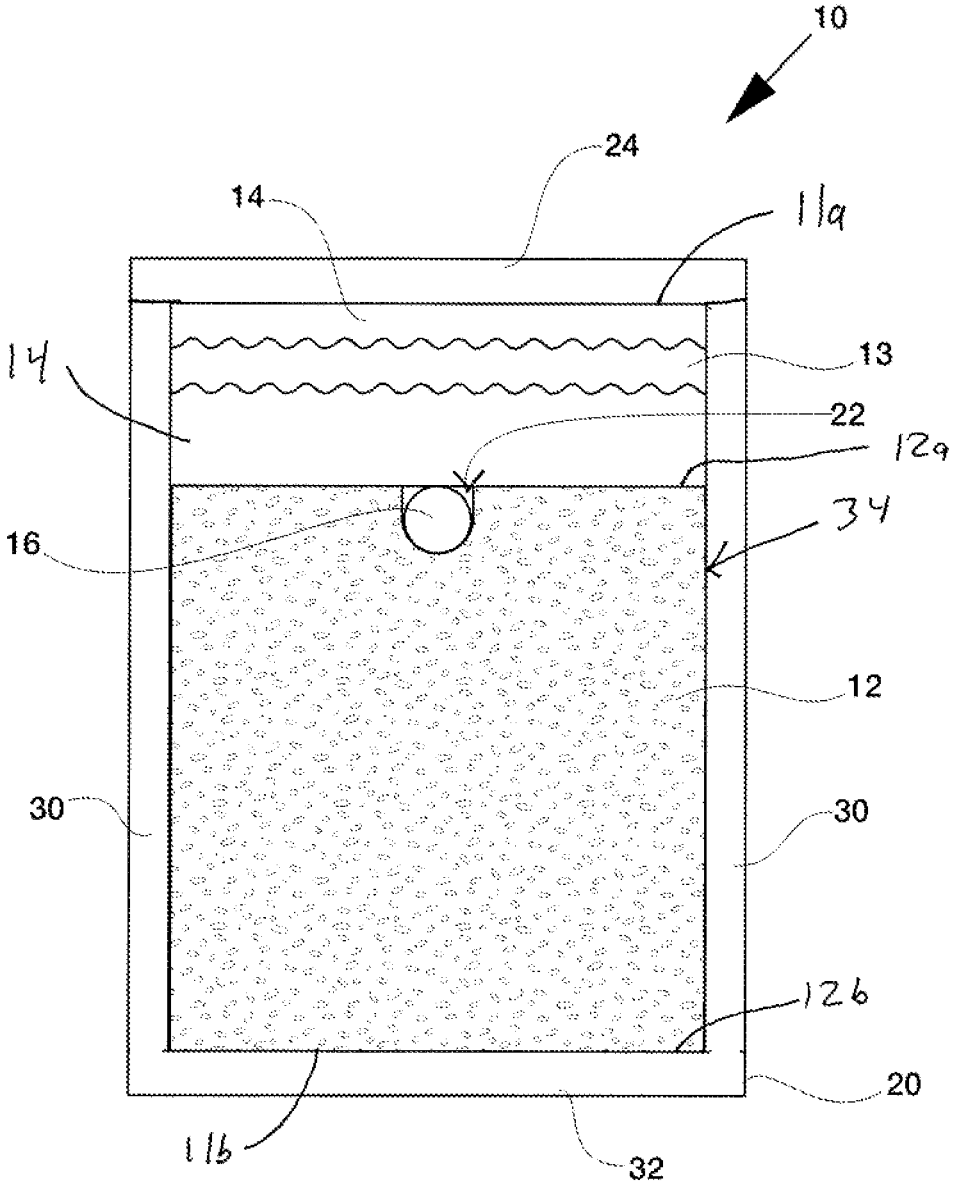
FIG. 4 is a cross-sectional view taken along section line 4-4 of FIG. 2.

With continued reference to FIGS. 1-4, the breaching device 10 may also include an explosive material 16. The breaching device 10 may be supplied with the explosive material 16 or the explosive material 16 may be added to the breaching device by a member of a breaching team. The explosive material 16 is disposed along the target surface 12*a* of the tamping material 12. The tamping material 12 may include a groove 22 defined in the target surface 12*a* and configured to receive the explosive material 16 therein. The groove 22 may be formed as the tamping material 12 is formed, e.g., as a gel cures or may be formed after the tamping material 12 is fully formed. The explosive material 16 may extend through multiple breaching devices 10. For example, as shown in FIG. 3, a single element of explosive material 16 extends through a first breaching device 10 and a second breaching device 10'.

The explosive material 16 may be detonation cord and may have a range of about 30 grains to about 100 grains per linear foot, e.g., about 50 grains per linear foot. In some embodiments, the explosive material 16 may be a plastic explosive or a sheet explosive.

The use of the breaching device 10 will be detailed with reference to FIGS. 1-4. Initially, a target is designated for an explosive breach. The target may be a door, a wall, a gate, a window, a roof, etc. With the target selected, a user determines a breaching solution for the target. With the breaching solution determined, the user selects a breaching device 10. The breaching device 10 includes a tamping material 12 and may include an explosive material 16, a pushing medium 14, and/or a housing 20. In embodiments where the breaching device 10 does not include the explosive material 16, the user may install the explosive material 16 into the breaching device 10.

The breaching device 10 may be selected such that the body 11 has an elongated shape adapted for installation onto a door along and adjacent its hinges. For example, the body 11 of a selected breaching device 10 may have a length of about 79.5 inches, a width of about 1 inch, and a height of about 1.5 inches. The breaching device 10 may be provided as a kit as detailed below. When the breaching device 10 is provided as a kit, the kit may be assembled by linking multiple breaching devices 10 together such that the individual breaching devices 10 detonate substantially simultaneously or in series with one another.

In embodiments, the breaching device 10 available may be configured as a pushing charge and include the pushing medium 14 and the breaching solution may require a blasting charge. In such embodiments, the user may modify the breaching device 10 from a pushing charge to a blasting charge by removing the pushing medium 14 and/or reducing a height of the sidewalls 30 to accommodate the pushing medium 14. The breaching device 10 may include features, e.g., perforation lines 140 (FIGS. 8*a*-8*c*), to assist in modifying the type of charge of the breaching device 10.

In some embodiments, the breaching device 10 available may have a length greater than a length required by the breaching solution. In such embodiments, the user may modify the breaching device 10 by cutting the housing 20 and/or the body 11 to a desired length. The breaching device 10 may include features, e.g., perforation lines 140 (FIGS. 8*a*-8*c*), to assist in modifying a length of the breaching device 10.

With the breaching device 10 modified to the breaching solution, the explosive material 16 may be installed by exposing a groove 22 in a target surface 12*a* of the tamping material 12 and disposing the explosive material 16 within the groove 22. The explosive material 16 may extend beyond one or both ends of the tamping material 12. In some embodiments, the groove 22 is exposed by peeling back or removing a portion of a pushing medium 14 that is disposed along the target surface 12*a* of the tamping material 12 and disposing the pushing medium 14 over the explosive material 16 within the groove 22. The pushing medium 14 may retain the explosive material 16 within the groove 22. In some embodiments where the tamping material 12 does not include a groove 22, the explosive material 16 is installed by pressing the explosive material 16 into the target surface 12*a* of the tamping material 12. The explosive material 16 may be centered along the target surface 12*a* or may be offset from a centerline of the target surface 12*a*.

With the explosive material 16 installed within the breaching device 10, the breaching device 10 is attached or secured to the target with the target surface 12*a* of the tamping material 12 facing the target. The breaching device 10 may be attached or secured to the target by an adhesive layer 24 applied to a target surface 11*a* of the body 11 that is configured to be in contact with the target. The target surface 11*a* of the body 11 may be the target surface 12*a* of the tamping material 12, a surface of the pushing material 14 facing the target, or a surface of the reinforcement material 13 facing the target.

When the breaching device 10 is attached or secured to the target, the user and/or other members of the breaching team, who intend to make entry through the breach, back off a standoff distance from the target and the user detonates the explosive material 16. Upon detonation, the tamping material 12 reflects a portion of an explosive force of the explosive material 16 directed away from the target, towards the target and thus, reduces the effect of the explosive force away from the target and increases the explosive force toward the target.

By reducing the effect of the explosive force away from the target, the standoff distance can be decreased. The standoff distance from a given explosive breach depends on the net explosive weight of the explosive material, the materials involved in charge construction, and other environmental factors. The tamping material 12 and construction of the breaching device 10 reduce the weight of the explosive material 16 required for a given target. In addition, the materials used in the construction of the breaching device 10 reduce a potential harm to a user and/or other breaching team members such that the standoff distance can be reduced. For example, when a breaching device is constructed using rigid components, e.g., metal or rigid plastic components, the standoff distance is greater to decrease the possibility of shards of the rigid components becoming shrapnel and injuring team members. As the breaching device 10 includes substantially non-rigid, e.g., cardboard, gel, and rubber, and does not include rigid components, the standoff distance can be reduced when compared to another breaching device including metallic or rigid plastic components. Thus, the non-metallic components of the breaching device 10 allow for a reduced standoff distance. A reduced standoff distance from the target reduces the access time for a breaching team, which may increase the efficacy of a breaching operation in support of follow-on operations. For example, with reduced standoff distance, a breaching team may make entry to the structure or room while the occupants are still dazed or disoriented, increasing the survivability of the team members, hostiles behind the breaching target, and/or friendlies behind the breaching target, e.g., hostages.

When a the breaching device 10 includes the pushing medium 14, the explosive force directed to the target presses the pushing medium 14 towards the target such that the pushing medium 14 distributes the explosive force onto a desired portion of the target. The pushing medium 14 may also act as a cutting means to sever a component of the target, e.g., a hinge or a lock of a door.

The explosive force and/or the pushing medium 14 creates a breach by cutting or shearing components of the target. For example, the explosive force may shear hinges or a locking mechanism of a door allowing breaching team to gain entry through the door.

After the detonation, the user and/or breaching team members pass through the breach to complete the breaching operation. As noted above, the tamping material 12 may be a non-slip material such that after the detonation, any tamping material 12 that is on the ground does not create a slip hazard for the breaching team members.

Figure 6:
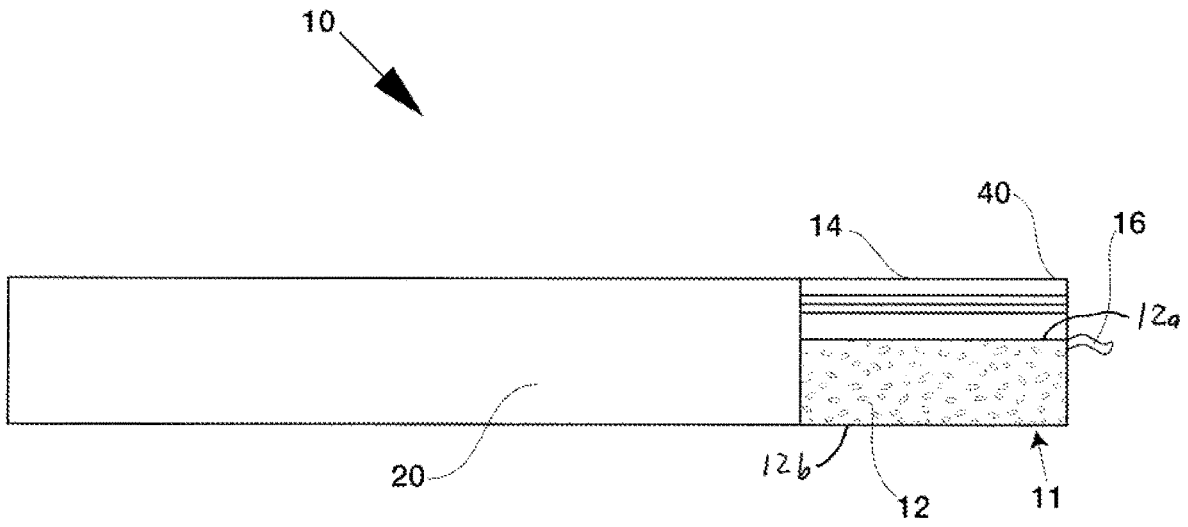
FIG. 6 is a shortened, side elevation view of the breaching device of FIG. 2.
Figure 7:
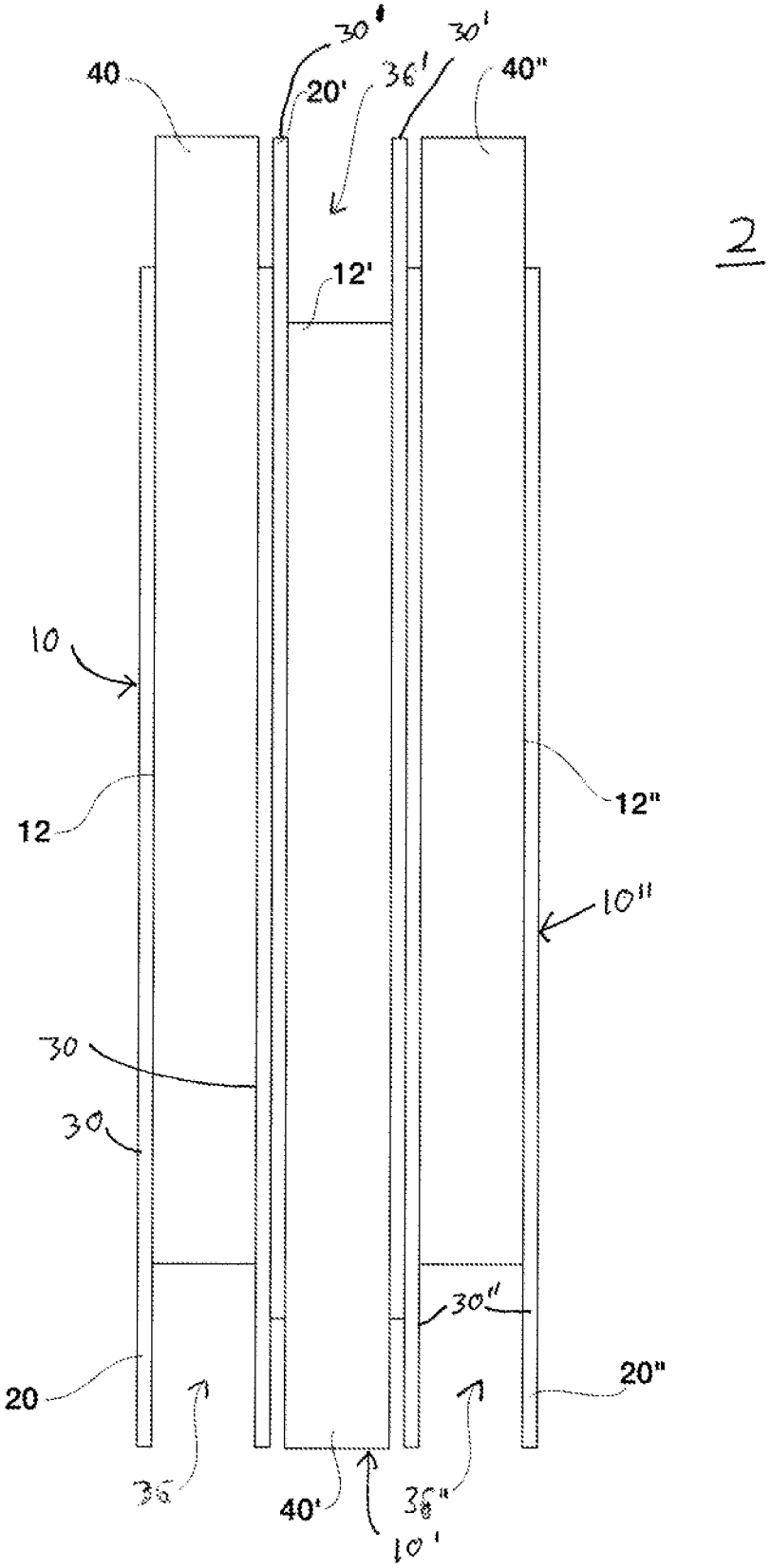
FIG. 7 is a top plan view of a kit provided in accordance with the present disclosure including multiple breaching devices.

Referring now to FIGS. 6 and 7, an exemplary kit 2 is provided in accordance with the present disclosure. The kit 2 includes one or more breaching devices 10, 10', 10". Each of the breaching devices 10, 10', 10" is similar to the breaching device 10 detailed above with the differences detailed below. Specifically, each cavity 34, 34', 34" includes a void 36, 36', 36" defined between sidewalls 30, 30', 30" of the respective housing 20, 20', 20". In addition, each body 11, 11', 11" includes a protruding portion 40, 40', 40" that is sized and dimensioned to be received within a respective one of the voids of the cavities 34, 34', 34". In use, the kit 2 may allow for multiple breaching devices 10, 10', 10" to be concatenated together to form a single breaching device. In such a device, a single element of explosive material 16, e.g., a single detonation cord, can extend through each of the breaching devices 10, 10', 10". This allows for concatenation of multiple breaching devices into one new elongated device. This may enable a single explosive detonation that extends along a door length, passing each of the door hinges, so that the explosive force is exerted against all of the hinges at the same time. If needed, the device can be cut to a desired size in the field.

Allowing multiple breaching devices 10 to be assembled into a single device may allow for easier transport to a target. In addition, the breaching device 10 or the kit 2 detailed herein may have reduced weight and be easier to transport when compared to other tamping devices, e.g., devices that use water in as a tamping material. In some embodiments, the kit 2 may have three pieces that are each about 1 inch wide and about 26.50 inches in length and weigh less than 5.5 pounds. In such an embodiment, the kit 2 could assemble into a single breaching device having a length of about 79.5 inches which is the height of a standard-sized residential door in the United States. Other dimensions are for breaching devices and number of breaching devices of a kit 2 to accommodate other standard size doors are anticipated. In some embodiments, the number of breaching devices 10 of a kit 2 are determined by the number of hinges for a given size door and the length of each breaching device 10 is determined such that the each breaching device 10 of a kit 2 is substantially centered at a hinge of the standard size door. The breaching devices 10 of a kit 2 may each have the same length or may have differing lengths.

Figure 8:
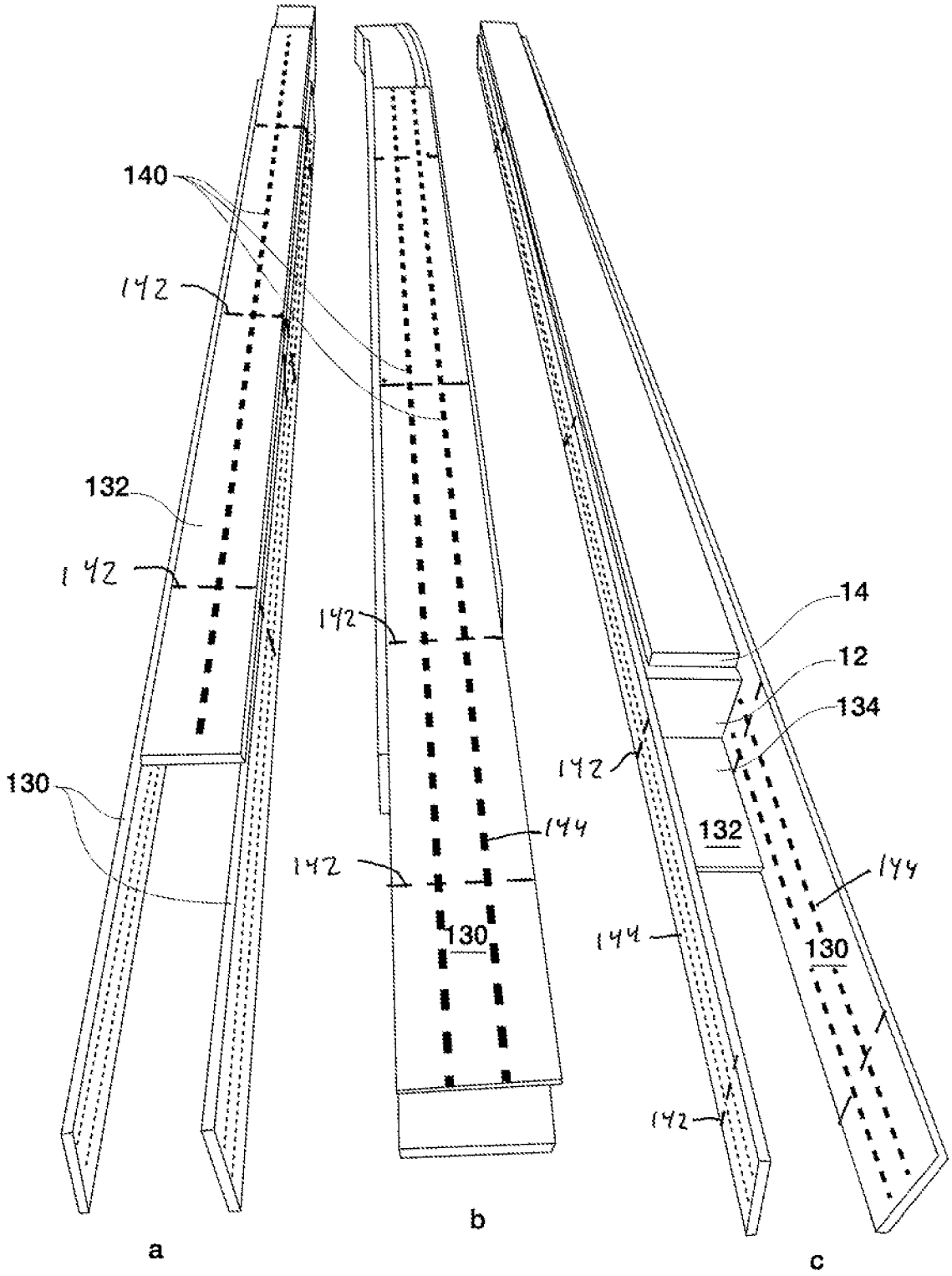
FIG. 8*a* is a top perspective view of an exemplary breaching device having another housing provided in accordance with the present disclosure including perforation lines.
FIG. 8*b* is a side perspective view the of housing of FIG. 8*a;*
FIG. 8*c* is a bottom perspective view of the housing of FIG. 8*a;*

Referring now to FIGS. 8A-8C, the housing 20 may include one or more perforation lines 140 defined in the sidewalls 30 and/or the backing wall 32. The perforation lines 140 are spaced along external surfaces of the sidewalls 30 and/or the backing wall 32 to provide reference points for cutting the breaching device 10 to a desired length. As detailed above, when a user determines a breaching solution, the breaching device 10 may be modified by reducing a length of the breaching device 10 to a desired length. The perforation lines 142 are equally spaced a known dimension, e.g., about 1 inch, about 4 inches, or about 8 inches, apart from one another such that a user can quickly identify where to cut the breaching device 10. Each of the perforation lines 142 extends around an outer surface of the housing 20 in each of the sidewalls 20 and the backing wall 32. In embodiments, the perforation lines 142 may include visual indicia of the overall length of the breaching device 10 at each perforation line 142. The visual indicia may reduce the need for a user to count the perforations 140. Additionally or alternately, perforation lines 144 may extend along a length of the sidewalls 30 at a position to provide visual indicia of a boundary between the tamping material 12 and the pushing medium 14 such that cutting along perforation lines 144 exposes the target surface 12*a* (FIG. 3) of the tamping material 12 and allows for the removal of the pushing medium 14 to convert the breaching device 10 from a pushing breaching device to a blasting breaching device as detailed above. In addition, the perforation lines 140 may be configured to separate when the explosive material 16 is detonated to reduce the fragment size of the housing 20. Reducing the fragment size of the housing 20 may reduce the safe standoff distance required for a given weight of explosive material 16.

Figure 10:
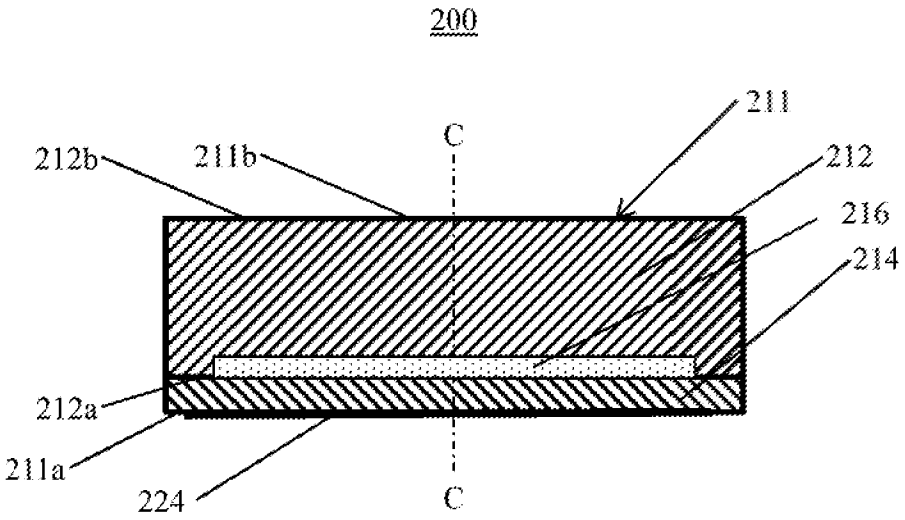
FIG. 10 is a cross-sectional view of taken along the section line 10-10 of FIG. 9.
Figure 9:
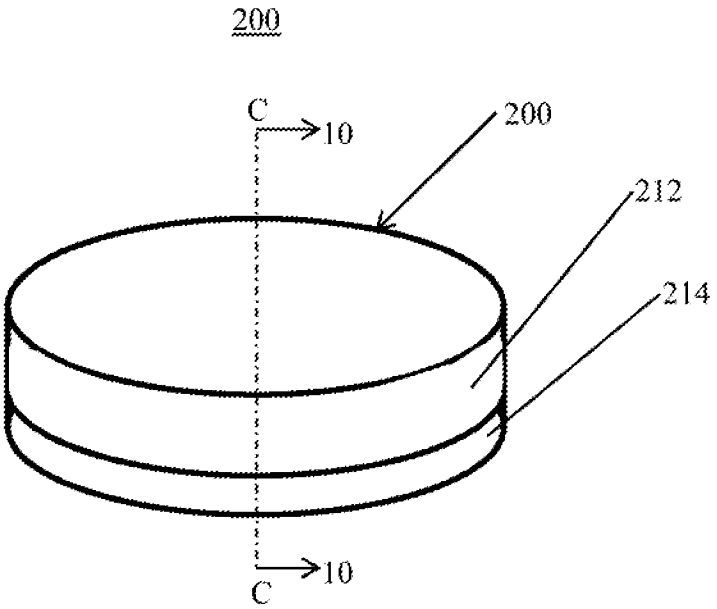
FIG. 9 is a perspective view of another breaching device in accordance with the present disclosure.

With reference to FIGS. 9 and 10, another tamping and breaching device is provided in accordance with the present disclosure and is generally referred to as breaching device 200. The breaching device 200 may be in the form of a puck having a substantially cylindrical body 211. The body 211 includes a circular target surface 211*a* and a circular backing surface 211*b* opposite the target surface 211*a*. The target surface 211*a* may have a diameter in a range of about 4 inches to about 12 inches, e.g., about 6 or 8 inches. The body 211 includes a tamping material 212 and a pushing medium 214 and may have a total thickness of about 1.5 inches. The tamping material 212 and the pushing medium 214 may be formed of similar materials to the tamping material 12 and pushing medium 14 detailed above and thus, only the differences will be detailed herein for brevity. The breaching device 200 may be provided as part of a kit having multiple breaching devices 200. In embodiments, the breaching device 200 may be in the form of a rectangular prism with a target surface length of in a range of about 4 inches to about 16 inches and a target surface width in a range of about 1 inch to about 12 inches and a depth between the target surface and a backing surface in a range of about 1 inch to about 3 inches.

The breaching device 200 is configured to receive an explosive material 216 between the tamping material 212 and the pushing medium 214. For example, the body 211 of the breaching device 200 can be separated along a boundary between the tamping material 212 and the pushing medium 214 and the explosive material 216 may be disposed between the tamping material 212 and the pushing material 214 and then the body 211 may be reassembled. Specifically, a coil or ring of detonation cable can be pressed into a target surface 212*a* of the tamping material 212 and then the body 211 reassembled as shown in FIG. 10. In some embodiment where the explosive material 216 is in the form of a sheet and disposed between tamping material 212 and the pushing medium 214. In embodiments, the explosive material 216 may be an amount of plastic explosive that is pressed into the target surface 212*a* of the tamping material 212 at or adjacent to a center of the target surface 212*a*. In particular embodiments, the body 211 defines a groove (not shown) about an outer surface of the tamping material 212 that is configured to receive the explosive material 216. In such embodiments, the explosive material 216 may be a detonation cable that is received within the groove. In particular embodiments, the tamping material 212 defines a pocket or a groove (not shown) about a central axis of the body 211. In such embodiments, the explosive material 216 may be plastic explosive that is sized and shaped to fit within the groove. The amount of explosive material may be selected based on a breaching solution for a particular breaching operation.

In use, one or more breaching devices 200 are place on a target with the target surface 211*a* secured to the target. The target surface 211*a* may include an adhesive 224 to secure the breaching device 200 to the target. The breaching device 200 may be placed at a location of a hinge or a locking member of the target. When detonated, the tamping material 212 reflects explosive energy directed away from the target towards the target and the explosive energy drives the pushing medium 214 towards the target to create a breach. For example, the explosive energy may shear hinges of a door or a locking mechanism of the door allowing entry.

The breaching devices 10 and 200 and the kits, e.g., kit 2, detailed above may include one or more of the following advantages. The breaching devices 10, 200 and kits are lightweight, portable, and/or easy to assembly during a breaching operation. In addition, an individual breaching device 10, 200 or a kit can be easily modified in length, explosive content, and/or between pushing charge and an explosive charge during a breaching operation to provide maximum flexibility for a single breaching device 10, 200 or kit. Further, in use, the breaching devices 10, 200 and kits detailed herein are easy to assembly, easy to hang or attach to a target, and stable to transport and/or store. The breaching devices 10, 200 and kits can be used in and have been tested in all weather conditions. The tamping material 12 has also been shown to be an effective tamping agent that is non-toxic, does not melt, and does not pose a slip hazard after detonation of the breaching device. In addition, the breaching devices 10, 200 are entirely non-metallic to reduce harmful shrapnel during breaching operations.

Certain modifications and improvements will occur to those skilled in the art upon reading the foregoing description. By way of example, the housing and body may share an identical length, without a protruding portion or cavity at either end of the device for interlocking with a second device. It should be understood that all such modifications and improvements have been omitted for the sake of conciseness and readability, but are properly within the scope of the following claims.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A breaching device comprising:

a body configured to contain an explosive material, the body having a target surface and a backing surface opposite the target surface, the target surface configured to face a target to be breached, the body including a tamping material formed of silicone gel, the tamping material configured to reflect an explosive force directed away from the target surface towards the target to be breached when the target surface faces the target to be breached.

2. The breaching device according to claim 1, wherein tamping material has a Shore hardness in the range between 020 and 040.

3. The breaching device according to claim 1, wherein the target surface of the body is elongate rectangular in shape.

4. The breaching device according to claim 3, wherein the body has a width in a range between 0.5 inches to 1.5 inches and a height between the target surface and the backing surface in a range between 0.5 inches and 2 inches.

5. The breaching device according to claim 4, wherein the body has a length in a range between 6 inches and 80 inches.

6. The breaching device according to claim 1, wherein the target surface of the body is circular in shape.

7. The breaching device according to claim 6, wherein the target surface has a diameter in a range between 4 inches and 16 inches.

8. The breaching device according to claim 1, wherein the tamping material forms the backing surface of the body, the backing surface being planar.

9. The breaching device according to claim 1, wherein the tamping material defines a groove in a surface configured to face the target, the groove configured to receive an explosive material.

10. The breaching device according to claim 1, wherein the body is entirely formed of non-metallic materials.

11. The breaching device according claim 1, wherein the body includes a pushing medium forming the target surface of the body, the pushing medium configured to press into a target in response to and distribute the explosive force at a portion of the target.

12. The breaching device according to claim 11, wherein the body is separable along a boundary between the tamping material and the pushing medium.

13. The breaching device according to claim 11, wherein the target surface includes an adhesive configured to attach the body to the target.

14. The breaching device according to claim 11, wherein the breaching device is convertible from a pushing charge to a blasting charge.

15. The breaching device according to claim 11, further comprising a housing having two sidewalls interconnected by a backing wall, each sidewall formed along a side surface of the body and the backing wall formed along the backing surface of the body, the side surfaces of the body interconnecting the target surface and the backing surface.

16. The breaching device according to claim 15, wherein each sidewall of the housing includes a perforation line aligned with the boundary between the tamping material and the pushing medium and configured to provide visual indicia of the position of the boundary.

17. The breaching device according to claim 15, wherein the housing includes a perforation line that extends around an outer surface of the housing in each of the sidewalls and the backing wall, the perforation line configured to provide visual indicia of a predetermined length from an end of the body.

18. The breaching device according to claim 15, wherein the housing is formed of cardboard.

19. The breaching device according to claim 15, wherein the body includes a protruding portion that extends beyond a first end of the housing, wherein a second end of the housing extends beyond the body to form a void between the second end of the housing and the body, the void configured to receive a protruding portion of another breaching device.

20. A breaching kit comprising:

a first breaching device according to claim 1; and a second breaching device according to claim 1, the first breaching device being configured to interlock with the second breaching device to form a single breaching device.

21. The breaching device according to claim 1, wherein the tamping material includes a cured silicone gel such that the tamping material holds a form.

* * * * *